US008505910B2

(12) United States Patent
Kato et al.

(10) Patent No.: US 8,505,910 B2
(45) Date of Patent: Aug. 13, 2013

(54) SWIRLING VANE WHEEL ACCUMULATING APPARATUS

(75) Inventors: Haruyasu Kato, Inagi (JP); Mitsutaka Nishida, Inagi (JP); Hayato Minamishin, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 0 days.

(21) Appl. No.: 13/488,933

(22) Filed: Jun. 5, 2012

(65) Prior Publication Data

US 2012/0312664 A1 Dec. 13, 2012

(30) Foreign Application Priority Data

Jun. 13, 2011 (JP) ..... 2011-131311

(51) Int. Cl.
*B65H 29/20* (2006.01)

(52) U.S. Cl.
USPC ..... 271/187; 271/204; 271/315

(58) Field of Classification Search
USPC ..... 198/470.1, 867.12; 271/187, 189, 271/204, 218, 315
See application file for complete search history.

(56) References Cited

U.S. PATENT DOCUMENTS

| | | | | |
|---|---|---|---|---|
| 4,205,837 | A * | 6/1980 | von Hein et al. | 271/270 |
| 4,487,408 | A * | 12/1984 | Fischer | 271/233 |
| 4,501,418 | A * | 2/1985 | Ariga et al. | 271/187 |
| 4,537,390 | A * | 8/1985 | Kiamco et al. | 270/58.29 |
| 4,861,019 | A * | 8/1989 | Michalik | 271/315 |
| 4,886,260 | A * | 12/1989 | Reist | 270/60 |
| 5,261,656 | A * | 11/1993 | Gutov et al. | 271/243 |
| 5,630,584 | A * | 5/1997 | Seeber | 271/315 |
| 6,131,904 | A * | 10/2000 | Tomczak | 271/315 |
| 6,168,152 | B1 * | 1/2001 | Ratz | 271/204 |
| 6,394,449 | B1 * | 5/2002 | Reist | 271/204 |
| 6,612,563 | B1 * | 9/2003 | Noll, Jr. | 271/69 |
| 7,048,110 | B2 * | 5/2006 | Hachiya et al. | 198/470.1 |
| 7,111,742 | B1 * | 9/2006 | Zimmermann | 209/665 |
| 7,784,784 | B2 * | 8/2010 | Meyerhans et al. | 271/204 |
| 7,802,780 | B2 * | 9/2010 | Mader et al. | 270/52.25 |
| 7,950,651 | B2 * | 5/2011 | Wylie | 271/187 |
| 8,157,263 | B2 * | 4/2012 | Noll, Jr. | 271/315 |

FOREIGN PATENT DOCUMENTS

| | | |
|---|---|---|
| JP | 09-278262 | 10/1997 |
| JP | 2008-084170 | 4/2008 |

* cited by examiner

*Primary Examiner* — Douglas Hess
(74) *Attorney, Agent, or Firm* — Greer, Burns & Crain, Ltd.

(57) ABSTRACT

Large-diameter entry rollers, and small-diameter entry rollers pressing against the large-diameter entry rollers via a conveyance belt enter a paper sheet in an accumulation part via an entrance slot. A central upper guide member makes contact with an upper surface of a central portion of the banknote. Both sides lower guide members guide the banknote while causing the banknote to curve in the shape of large U in a direction orthogonal to a conveyance direction of the banknote by lifting up both ends of the banknote entered in the accumulation part with the use of an upwardly curved tip. The front end of the banknote does not hang down despite being beaten by vanes, and the banknote goes between the vanes. The banknote is rotationally conveyed, hits the stoppers to stop, is disengaged from a swirling vane wheel, and is accumulated.

3 Claims, 9 Drawing Sheets

SWIRLING VANE WHEEL ACCUMULATING APPARATUS

CROSS REFERENCE TO RELATED APPLICATION

This application is based upon and claims the benefit of priority from prior Japanese Application No. 2011-131311, filed Jun. 13, 2011, the entire contents of which are incorporated herein by reference.

BACKGROUND OF THE INVENTION

1. Field of the Invention

The present invention relates to a swirling vane wheel accumulating apparatus, and more particularly, to a swirling vane wheel accumulating apparatus in a paper sheet accumulating apparatus, available also alone as a reject storing unit for storing a banknote identified as being defective or deformed in an ATM (Automated Teller machine) or the like, or as an organizing machine of forms or a counter of valuable instruments.

2. Description of the Related Art

Conventionally, swirling vane wheel accumulating apparatuses for storing banknotes in a banknote storing unit by using a vane wheel provided with swirling vanes as a banknote storing mechanism of an ATM or the like are conventionally proposed, for example, as disclosed by Japanese Laid-open Patent Publication No. 2008-84170 or Japanese Laid-open Patent Publication No. HEI09-278262.

These swirling vane wheel accumulating apparatuses guide a banknote up to stoppers while preventing the banknote from colliding with the rear of another banknote by sliding the banknote between vanes of the vane wheel.

Then, the banknote is stored in the banknote storing unit with repetitions such that each banknote, the front end of which is stopped by stoppers with a rotation of the vane wheel, is disengaged from between the vanes and drops downward onto a storing unit plate.

Incidentally, banknotes that customers deposits into an ATM or the like are not always neat in shape. Some of them are heavily wrinkled or worn out to become less stiff. Especially, in countries where people usually carry bare banknotes in a pocket or the like, a large number of heavily wrinkled banknotes or worn-out banknotes with low stiffness are distributed.

If such a heavily wrinkled banknote or a banknote with low stiffness is entered in a deposit slot of an ATM or the like as a deposit note, it is identified by an identifying unit as being defective or deformed, so that the banknote is stored in a reject box (reject storing unit) in many cases.

The reject storing unit is provided to meet various objectives, and can be arbitrarily provided. A box as the reject storing unit itself is individually independently arranged depending on an objective of provision. For example, the reject storing unit is a storing unit for storing a banknote that is badly damaged by being folded, wrinkled, torn or the like and has a problem in future use, and an old banknote that is currently discontinued.

Another storing unit is that for storing a two-thousand yen note and a five-thousand yen note, which are least reused in withdrawals among regular banknotes, when being entered by customers. If a customer needs a two-thousand yen note or a five-thousand yen note at the time of a withdrawal, a dedicated money changer is used.

Additionally, some of storing units have a storing function as a left note collecting unit. The left note collecting unit is a collecting unit for a banknote accidentally left by a customer, and is not used when a customer deposits a banknote.

If a banknote entered by a customer is that of an unacceptable denomination such as a counterfeit note, a foreign note and the like, or a banknote having a problem in future use due to a large smudge or the like despite being not counterfeit, it is returned not to the reject box but a return pending unit.

Incidentally, a swirling vane wheel accumulating apparatus having a swirling vane wheel provided with swirling vanes as disclosed by Japanese Patent Publication No. 2008-84170 or Japanese Laid-open Patent Publication No. HEI09-278262 is provided at an entrance slot of banknotes and used as a storing unit that forms a temporary accumulation store like the above described reject storing unit.

Normally, a banknote that is entered in the swirling vane wheel accumulating apparatus as the reject storing unit is held by a vane wheel by being sandwiched between preceding and succeeding vanes, and disengaged from the vane wheel at a storage position and accumulated in the storing unit.

When the swirling vane wheel is configured by arranging a plurality of vane wheels in parallel, a banknote is guided to a gap with a different phase of each of the vane wheels and curved if it is deformed or the like.

If the banknote is curved, stiffness in its proceeding direction increases. As a result, the banknote does not go along with rotations of the swirling curved vanes of the vane wheels. Therefore, the banknote is disengaged from the vane wheels before reaching the stoppers, leading to an unstable state or jamming caused by the still engaged rear end of the banknote in many cases.

Alternatively, even if the number of vane wheels is reduced to one, the stiffness of a heavily wrinkled banknote or a worn-out banknote is low. Therefore, the banknote sometimes hangs down when its front end is beaten by the vanes of the vane wheel.

If the front end of the banknote hangs down, the banknote cannot go into the gap between the vanes of the vane wheel, and gets stuck immediately below the entrance slot of the storing unit with the rear end folded subsequently to the portion that hangs down and is not held by the vane wheel, so that the banknote frequently causes jamming along with a succeeding note in the reject storing unit.

Generally, banknotes that the identifying unit identifies as being irregular are stored in the reject storing unit. However, most of the banknotes that the identifying unit identifies as being irregular tilt or go to one side.

If a banknote tilts or goes to one side, it can possibly scratch or collide with a structural element on a surface side. Therefore, it becomes necessary to widely design a wall surface of the reject storing unit, posing a problem that the entire device increases in size.

Normally, the swirling vane wheel accumulating apparatus is used also alone as an organizer of forms or a counter of paper sheets in many cases in addition to an application as the reject storing unit of an ATM as described above. Forms and the like normally have low paper stiffness. Accordingly, there is a high possibility of the above described occurrence of jamming.

However, the above described Japanese Laid-open Patent Publication No. 2008-84170 or Japanese Laid-open Patent Publication No. HEI09-278262 does not disclose or suggest any preventive measures or solutions against jamming that can occur with high possibility when a damaged banknote with low stiffness is stored in the swirling vane wheel accumulating apparatus as the reject storing unit, or when a form is stored in the swirling vane wheel accumulating apparatus as an organizer or a counter.

SUMMARY OF THE INVENTION

The present invention overcomes the above described problems, and an object thereof is to provide a swirling vane wheel accumulating apparatus for stably accumulating even damaged banknotes or forms with low stiffness in a storing unit without causing jamming.

The swirling vane wheel accumulating apparatus according to the present invention is a swirling vane wheel accumulating apparatus having an accumulation part for storing a paper sheet. The swirling vane wheel accumulating apparatus includes: entering means for entering the paper sheet in the accumulation part via an entrance slot of the accumulation part; stoppers arranged on an end side opposed to the entrance slot; a swirling vane wheel arranged between the entrance slot and the stoppers; a central upper guide member, arranged to extend from the entering means up to a position close to both sides of a rotational area of vanes of the swirling vane wheel, for guiding an upper surface of a central portion of the paper sheet entered in the accumulation part by the entering means while preventing the central portion from floating above; both ends lower guide members, arranged on both sides of the entering means, for guiding both ends of the paper sheet entered in the accumulation part by the entering means, and for causing the paper sheet to curve in a shape of U by lifting up both the ends; and an up-and-down stage that is positioned below the swirling vane wheel and arranged to be able to go up and down independently of the entering means, the stoppers, the swirling vane wheel, the central upper guide member and the both ends lower guide members. The swirling vane wheel holds, in a gap between vanes, the paper sheet entered by being curved in the shape of U via the entrance slot, rotates the paper sheet, causes both the ends of the paper sheet, which extend off both sides of the vanes, to hit the stoppers so that the paper sheet is disengaged from the gap between the vanes and is accumulated on the up-and-down stage.

In this swirling vane wheel accumulating apparatus, for example, the both ends lower guide members may have a protruding part protruding from a surface of a conveyance direction of the paper sheet. Alternatively, for example, the swirling vane wheel accumulating apparatus may configure a reject storing unit for storing a paper sheet identified as being defective of deformed by an identifying unit on a side of an accepting apparatus that accepts the paper sheet.

With the swirling vane wheel accumulating apparatus according to the present invention, paper sheets are entered in the accumulation part by causing the paper sheets to curve in the shape of large U. Therefore, even damaged banknotes or forms with low stiffness are held by the vane wheel without hanging down despite being beaten by the vanes, and are disengaged from the vane wheel, whereby the banknotes or the forms can be stably accumulated in the accumulation part without causing jamming.

Additionally, with the swirling vane wheel accumulating apparatus according to the present invention, paper sheets are continuously curved in the shape of large U until being held between the vanes of the vane wheel after being entered into the accumulation part. With this curve, the paper sheets can be stably held by the vane wheel without strongly scratching or colliding with a wall surface of the reject storing unit, the paper sheets are released from a guide for making the paper sheets curve after being held by the vane wheel, and are stably accumulated by being curved to go along with the curve of the vanes. This eliminates the need for making the inside of the reject storing unit wider than the size of the paper sheets, whereby the entire apparatus can be prevented from increasing in size.

DESCRIPTION OF THE PREFERRED EMBODIMENTS

An embodiment according to the present invention is described below with reference to the drawings.

First Embodiment

Figure 1:
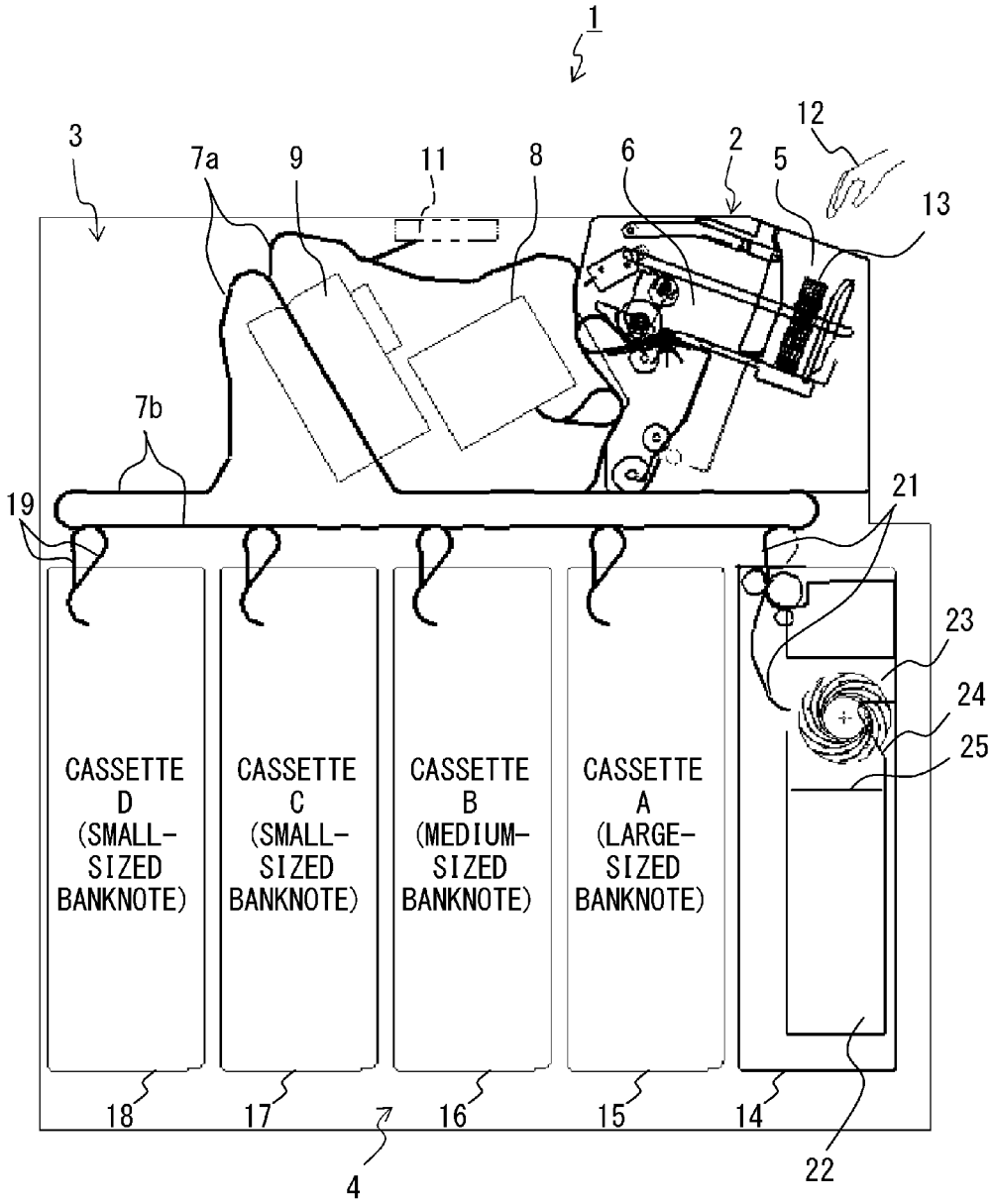
FIG. 1 is a cross-sectional view schematically illustrating a configuration of an ATM (Automated Teller Machine) including a swirling vane wheel accumulating apparatus according to a first embodiment of the present invention.

FIG. 1 is a cross-sectional view schematically illustrating a configuration of an ATM (Automated Teller Machine) (hereinafter referred to also as a main body apparatus) including a swirling vane wheel accumulating apparatus according to the first embodiment. The ATM 1 illustrated in this figure includes a banknote deposit/withdrawal device 2, a conveying unit 3 and a storing unit 4.

The banknote deposit/withdrawal device 2 has, on an upper surface formed to slightly tilt in a front (right) portion of the device, an input operation panel unit, not illustrated because of being cross-sectioned, a deposit/withdrawal unit 5 having a shutter in an upper opening, and a temporarily accumulating unit 6 for temporarily storing accumulated banknotes.

In the conveying unit 3, conveyance paths 7 (7*a*, 7*b*) are arranged by being crisscrossed. Each of the conveyance paths 7 is actually composed of many rollers, many belts bridged over the rollers, switching gates respectively arranged at branch points of the conveyance path, and the like although the paths are depicted only as black thick lines in FIG. 1.

To the upper conveyance path 7*a* of the main body apparatus 1, a pool part 8, an identifying unit 9, a dummy note holding part 11 and the like are linked. The pool part 8 temporarily stores a banknote 13 that is deposited in the deposit/withdrawal unit 5 by a customer 12, moves from the deposit/withdrawal unit 5 to the temporarily accumulating unit 6, and is fed from the temporarily accumulating unit 6 to the side of the main body apparatus.

If the number of banknotes 13 counted while being fed matches the number of banknotes 13 indicated by a number or a face value, which the customer 12 has input with the input operation panel unit, the banknotes 13 temporarily stored in the pool part 8 are taken out of the bottom of the pool part 8 one by one, and entered into the identifying unit 9.

The identifying unit 9 identifies whether a banknote that passes through inside is either real or false, whether or not the banknote is smudged, or whether or not a corner of the banknote is folded. Results of the identification made by the identifying unit 9 are notified to a central processing unit not illustrated. The central processing unit executes diverse processes based on the above notification while the banknote that has passed through the identifying unit 9 is being conveyed on the conveyance path 7*a*.

In the storing unit 4 positioned below the lower conveyance path 7*b* of the main body apparatus 1, a reject box 14, a cassette A 15 for storing a large-sized banknote, a cassette B 16 for storing a medium-sized banknote, cassettes C 17 and D 18 for storing a small-sized banknote are provided to be freely attachable/detachable.

On the top of each of the four cassettes A 15, B 16, C 17 and D 18, an entrance/exit path 19 is provided. Additionally, an entrance-only path 21 is provided on the top of the reject box 14. The conveyance path 7*b* is linked to the entrance/exit paths 19 and the entrance-only path 21 via a switching gate not illustrated.

Additionally, the reject box 14 includes a swirling vane wheel accumulating apparatus 22 according to this embodiment. A swirling vane wheel 23, stoppers 24 and a banknote accumulation up-and-down stage 25 are provided in an upper portion of the swirling vane wheel accumulating apparatus 22. In the swirling vane wheel accumulating apparatus 22 illustrated in this figure, conveyance rollers, guide members and the like, which are arranged between the entrance-only path 21 and the swirling vane wheel 23 and will be described in detail later, are not depicted.

In the ATM 1, when a customer 12 withdraws banknotes, banknotes having a face value and a number, which correspond to the amount of money that the customer has input with the input operation panel unit, are fed from the cassettes A 14, B 15, C 16 or D 17, which corresponds to each of the banknotes, to the conveyance path 7*b*, their denominations are verified by the identifying unit 9, and the banknotes are fed from the conveyance path 7*a* to the temporarily accumulating unit 6 and accumulated.

The total amount of the banknotes sequentially accumulated in the temporarily accumulating unit 6 matches the number of banknotes indicated by the face value and the number, which the customer 12 has input with the input operation panel unit, the accumulated banknotes are collectively moved to the deposit/withdrawal unit 5. Then, the shutter of the deposit/withdrawal unit 5 is opened to allow the customer 12 to take out the banknotes 12.

Additionally, when the customer 12 deposits banknotes in the ATM 1, the shutter of the deposit/withdrawal unit 5 is opened, and the customer 12 enters the banknotes into the deposit/withdrawal unit 5. The entered banknotes are collectively moved to the temporarily accumulating unit 6, and all of them are once stored from the temporarily accumulating unit 6 to the pool part 8.

The banknotes stored in the pool part 8 are fed from the pool part 8 to the conveyance path 7*a* one by one, and pass through the identifying unit 9. If the identifying unit 9 identifies each of the banknotes as being real and not smudged or torn, it is stored in any of the cassettes A 15, B 16, C 17 or D 18 within the storing unit 4, which corresponds to the banknote, via the conveyance paths 7*a* and 7*b*.

Alternatively, if the identifying unit 9 identifies the banknote as being unacceptable such as counterfeit or the like, it is inversely conveyed on the conveyance path 7*a* and returned to the temporarily accumulating unit 6.

Still alternatively, if the identifying unit 9 identifies the banknote not as being counterfeit but, for example, as being badly smudged and having a problem in future use, or as needed to be replaced with another one due to its heavy wrinkles, namely, if the identifying unit 9 identifies the banknote as being defective or deformed, it is stored in the reject box 14 or returned to the temporarily accumulating unit 6.

The above described defective or deformed banknote is expected to be distributed with high frequency until it is deposited, and such a banknote has low stiffness. Accordingly, when such a banknote is entered into the swirling vane wheel accumulating apparatus 22 as the reject box 14, the front end of the banknote hangs down by being beaten by the vanes of the vane wheel without being held by the vane wheel, leading to a higher possibility of an occurrence of jamming as described above.

With the swirling vane wheel accumulating apparatus 22 according to this embodiment, even a damaged banknote having low stiffness, or the like is held by the vane wheel without causing the front end of the banknote to hang down despite being beaten by the vanes, is disengaged from the vane wheel with the stoppers, and can be sequentially accumulated on a banknote accumulation up-and-down stage 25 in a stable manner without causing jamming.

Figure 2A:
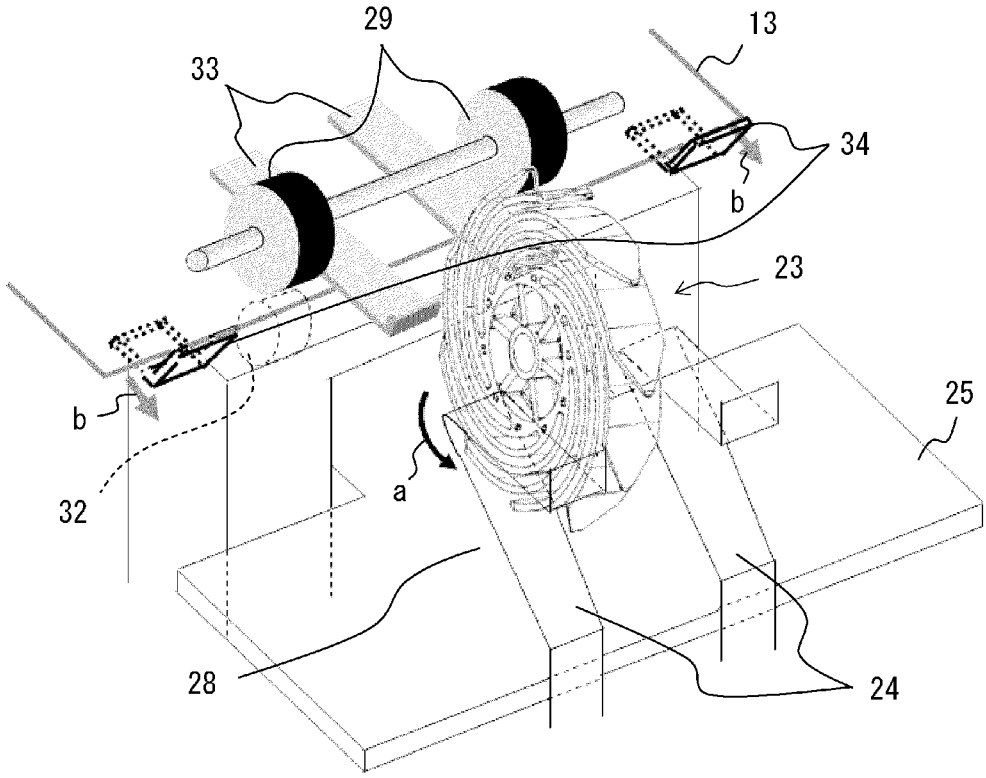
FIG. 2A is a perspective view illustrating a configuration of a banknote entry/accumulation mechanism of the swirling vane wheel accumulating apparatus according to the first embodiment.
Figure 2B:
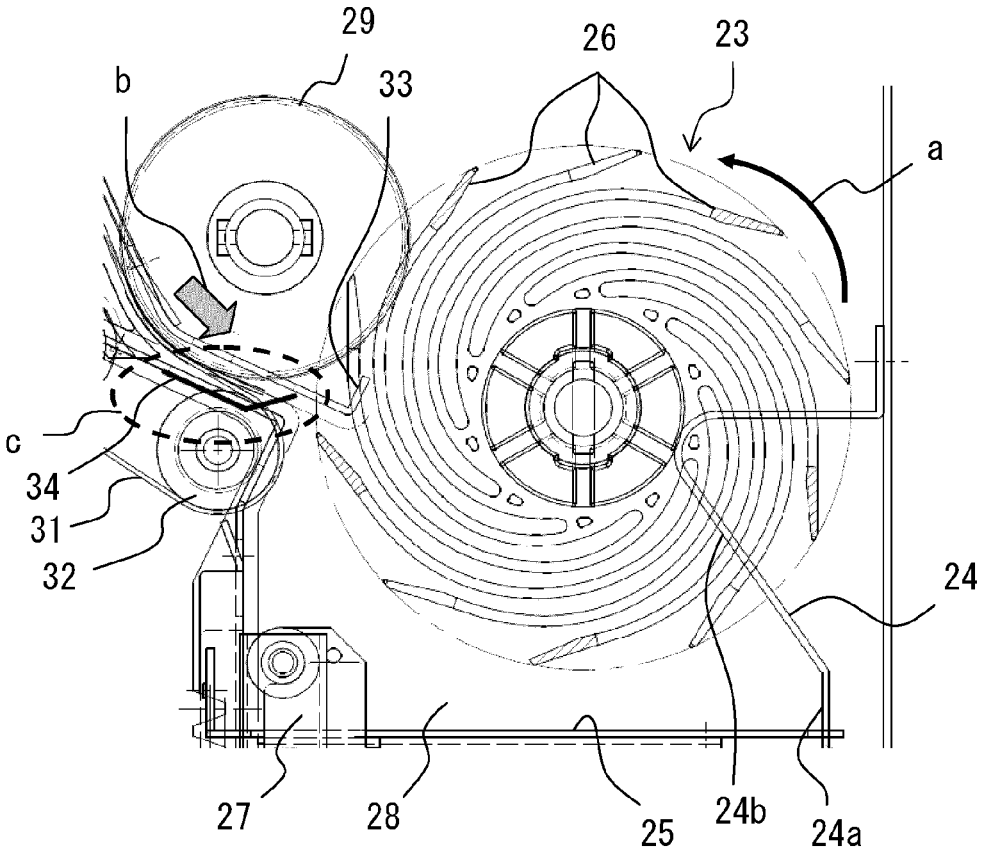
FIG. 2B is a side view illustrating the configuration of the banknote entry/accumulation mechanism of the swirling vane wheel accumulating apparatus according to the first embodiment.

FIG. 2A is a perspective view illustrating a configuration of a banknote entry/accumulation mechanism of the swirling vane wheel accumulating apparatus 22 according to this embodiment. FIG. 2B is a side sectional view of FIG. 2A. The same components in FIGS. 2A and 2B as those illustrated in FIG. 1 are denoted with the same reference numerals as those of FIG. 1.

As illustrated in FIGS. 2A and 2B, the banknote entry/accumulation mechanism unit of the swirling vane wheel accumulating apparatus 22 has, in its central portion, one swirling vane wheel 23 that rotates in a direction indicated with an arrow a. The swirling vane wheel 23 normally has a plurality of swirling vanes 26.

The up-and-down stage 25 that can go up and down by being linked to a raising/lowering device 27 and is also illustrated in FIG. 1 is arranged below the swirling vane wheel 23. The up-and-down stage 25 is positioned below the swirling vane wheel 23 and goes up and down independently of the swirling vane wheel 23 and the stoppers, which are also illustrated in FIG. 1, and a conveyance mechanism, a central upper guide member and both ends lower guide members, which will be described later.

Additionally, on one wall surface in a direction orthogonal to a rotational axis of the swirling vane wheel 23 of the banknote entry/accumulation mechanism unit, the two stoppers 24 illustrated in FIG. 1 are arranged by being disposed at positions that sandwich both sides of the swirling vane wheel 23.

Each of the stoppers 24 has an upright part 24*a* and an overhanging tilting part 24*b*. The overhanging tilting part 24*b* is arranged to overhang at each of the positions that sandwich both the sides of the swirling vane wheel 23, whereas the upright part 24*a* is formed to be continuous to the bottom of the overhanging tilting part 24*b*.

The accumulation mechanism of the swirling vane wheel accumulating apparatus 22 is configured with the swirling vane wheel 23 and the stoppers 24. Below the swirling vane wheel 23, a space formed with the bottom of the swirling vane wheel 23, the up-and-down stage 25 and the upright part 24*a* of the stoppers 24 form an accumulation part 28 of the banknote entry/accumulation mechanism unit.

Additionally, an entrance slot is formed on a wall surface opposed to the stoppers 24 of the banknote entry/accumulation mechanism. In the entrance slot, an entry mechanism for sending and feeding a banknote 13 into the accumulation part 28 as indicated with an arrow b is arranged. The entry mechanism is composed of large-diameter entry rollers 29, a conveyance belt 31, and small-diameter entry rollers 32.

The small-diameter entry rollers 32 respectively press against the large-diameter entry rollers 29 via the conveyance belt 31. The two small-diameter entry rollers 32 and the two large-diameter entry rollers 29 are provided. Part of a side surface of each of the large-diameter entry roller 29 overhangs at each of positions that sandwich the space of the rotational range of the vanes 26 of the swirling vane wheel 23.

On both sides ahead of the entry mechanism, the central upper guide member 33 and the both ends lower guide members 34 according to this embodiment are arranged. The central upper guide member 33 is arranged so that its tip extends from the middle of the two large-diameter entry rollers 29 to the rotational area of the vanes 26 of the swirling vane wheel 23.

The both ends lower guide members 34 illustrated within an ellipse c indicated with a broken line are positioned on both sides of each surface where each of the small-diameter entry rollers 32 presses against each of the large-diameter entry rollers 29 via the conveyance belt 31.

The both ends lower guide members 34 are arranged at positions corresponding to both ends of the banknote 13 entered by the entry mechanism. A tip of each of the both ends lower guide members 34 is positioned slightly before the rotational area of the vanes 26 of the swirling vane wheel 23, and formed to curve upward.

Figure 3A:
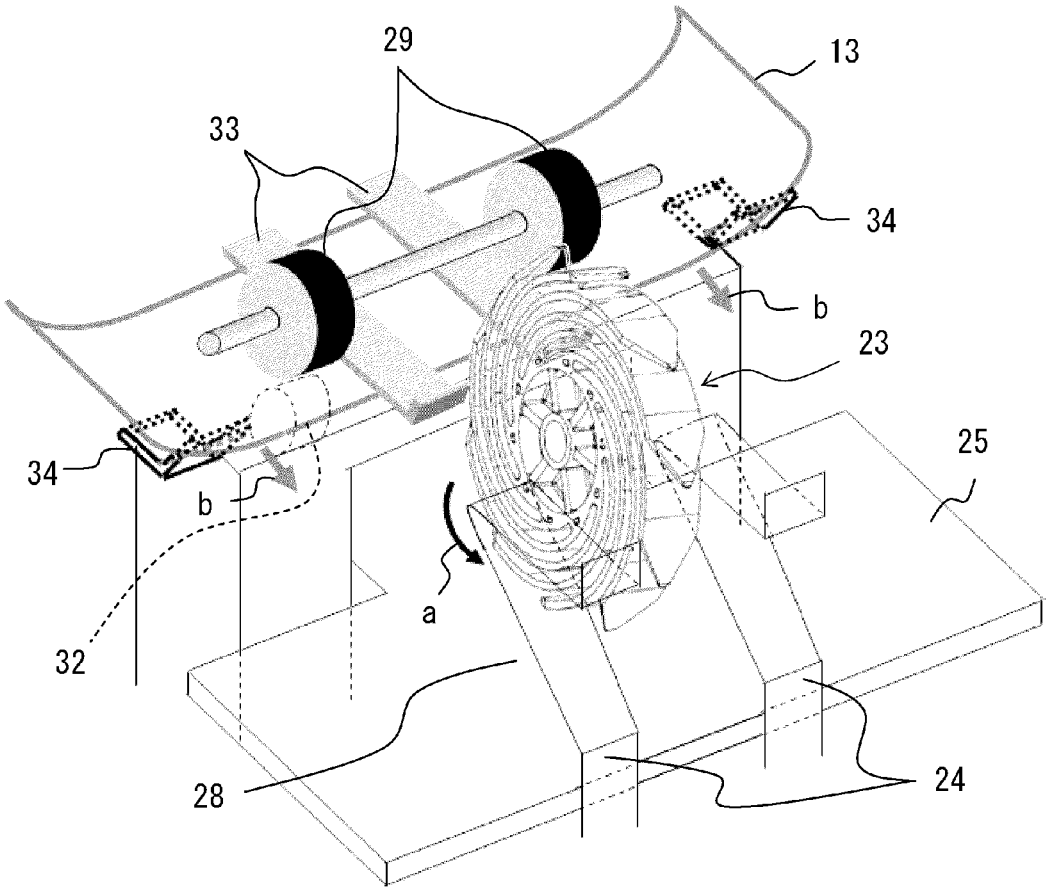
FIG. 3A is a perspective view (No. 1) illustrating an operation state of the swirling vane wheel accumulating apparatus according to the first embodiment when a banknote is entered.
Figure 3B:
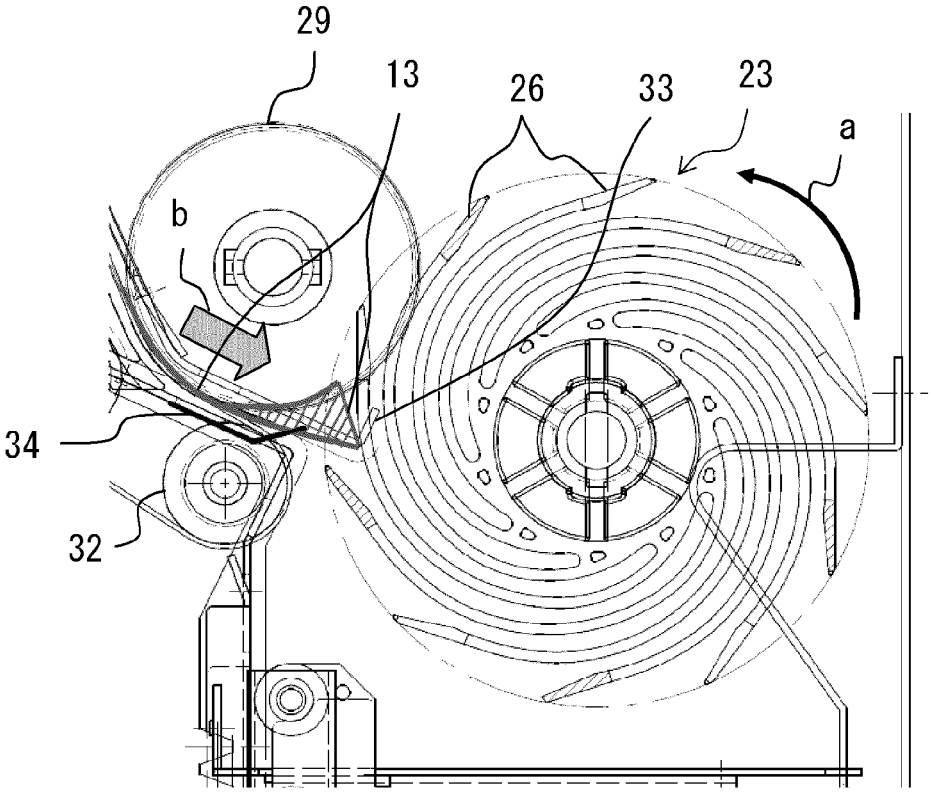
FIG. 3B is a side sectional view (No. 1) illustrating the operation state of the swirling vane wheel accumulating apparatus according to the first embodiment when the banknote is entered.

FIG. 3A is a perspective view illustrating an operation state of the swirling vane wheel accumulating apparatus 22 including the banknote entry/accumulation mechanism having the above described configuration when a banknote is entered. FIG. 3B is a side sectional view of FIG. 3A. The same components in FIGS. 3A and 3B as those of FIGS. 2A and 2B are denoted with the same reference numerals as those of FIGS. 2A and 2B.

As illustrated in FIGS. 3A and 3B, when the banknote 13 is entered into the accumulation part 28 by the entry mechanism composed of the large-diameter entry rollers 29 and the small-diameter entry rollers 32 as indicated with the arrow b, the central upper guide member 33 makes contact with an upper surface of a central portion of the banknote 13, and guides the banknote 13 while preventing the central portion from floating above.

In the meantime, the both ends lower guide members 34 guide the banknote 13 while causing the banknote 13 to curve in the shape of large U in a direction orthogonal to the conveyance direction of the banknote 13 by lifting up both ends of the banknote 13 to be entered into the accumulation part 28 as illustrated with the arrow b with the use of the upwardly curved tip.

As described above, even a banknote having paper quality of low stiffness, such as a worn-out banknote having a large smudge or a heavily wrinkled banknote left as being bare in a pocket, is caused to forcibly curve in the direction orthogonal to the conveyance direction of the banknote.

Accordingly, the front end to be entered of the banknote 13 is highly resistant to the curve in the entry direction. Therefore, the banknote 13 extends in the entry direction without hanging down even though the front end to be entered is beaten by the rotating vanes 26 of the swirling vane wheel 23.

Figure 4A:
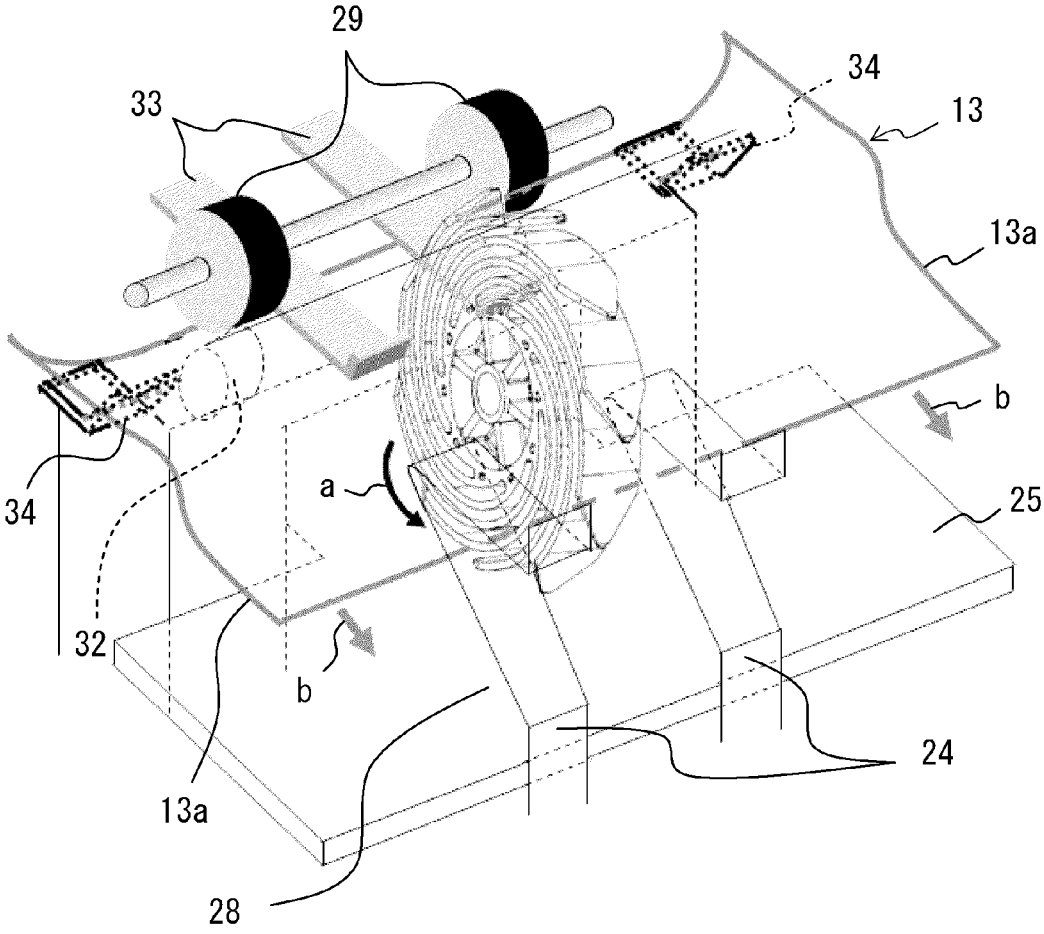
FIG. 4A is a perspective view (No. 2) illustrating the operation state of the swirling vane wheel accumulating apparatus according to the first embodiment when the banknote is entered.

FIG. 4A is a perspective view illustrating the operation state subsequent to the above described entry operation when the banknote is entered. FIG. 4A is a side sectional view of FIG. 4A. The same components in FIGS. 4A and 4B as those of FIGS. 3A and 3B are denoted with the same reference numerals as those of FIGS. 3A and 3B.

Figure 4B:
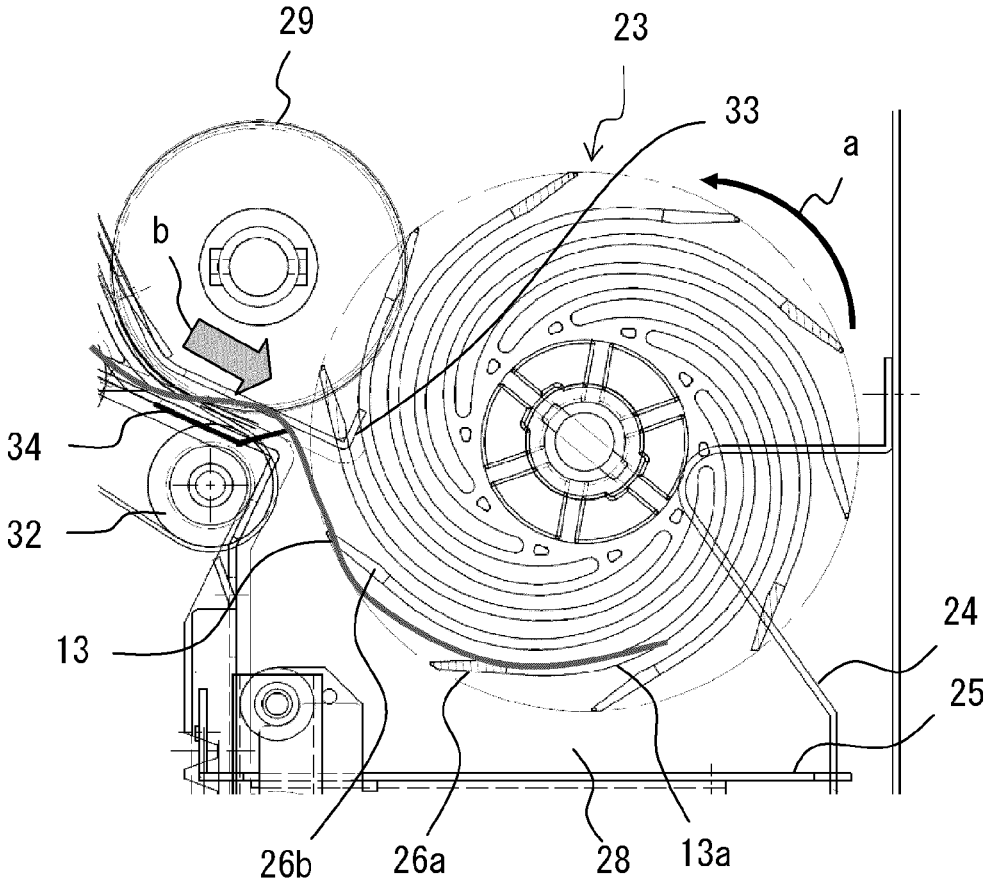
FIG. 4B is a side sectional view (No. 2) illustrating the operation state of the swirling vane wheel accumulating apparatus according to the first embodiment when the banknote is entered.

As illustrated in FIGS. 4A and 4B, the banknote 13 continuously being entered goes into a gap formed so that a preceding vane 26*a* and a succeeding vane 62*b* hold the banknote in synchronized entry timing, and the banknote 13 is held between the preceding vane 26*a* and the succeeding vane 26*b*.

The held portion of the banknote 13, which has been already released from the guide of the both ends lower guide members 34, is held to go along with the curve of the swirling vanes 26, and also both ends 13*a* of the banknote 13, which extend off the vanes 26, go along with the swirling vanes 26, so that the entire banknote 13 is rotationally conveyed.

Figure 5A:
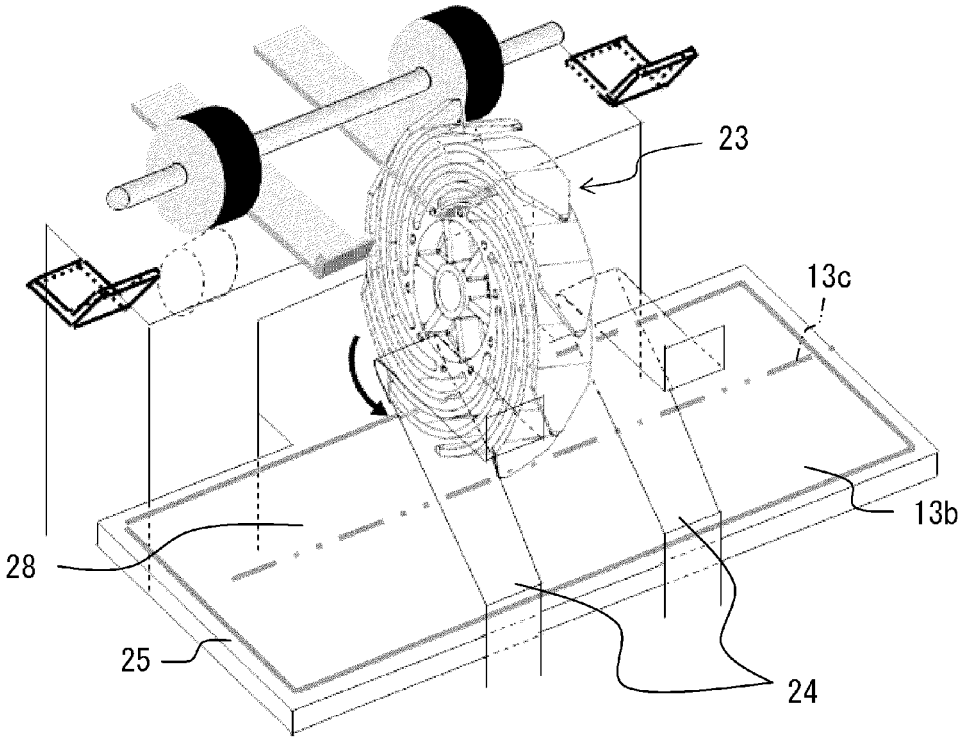
FIG. 5A is a perspective view illustrating an accumulation operation, subsequent to FIGS. 3A and 4A, of the entered banknote in the swirling vane wheel accumulating apparatus according to the first embodiment.
Figure 5B:
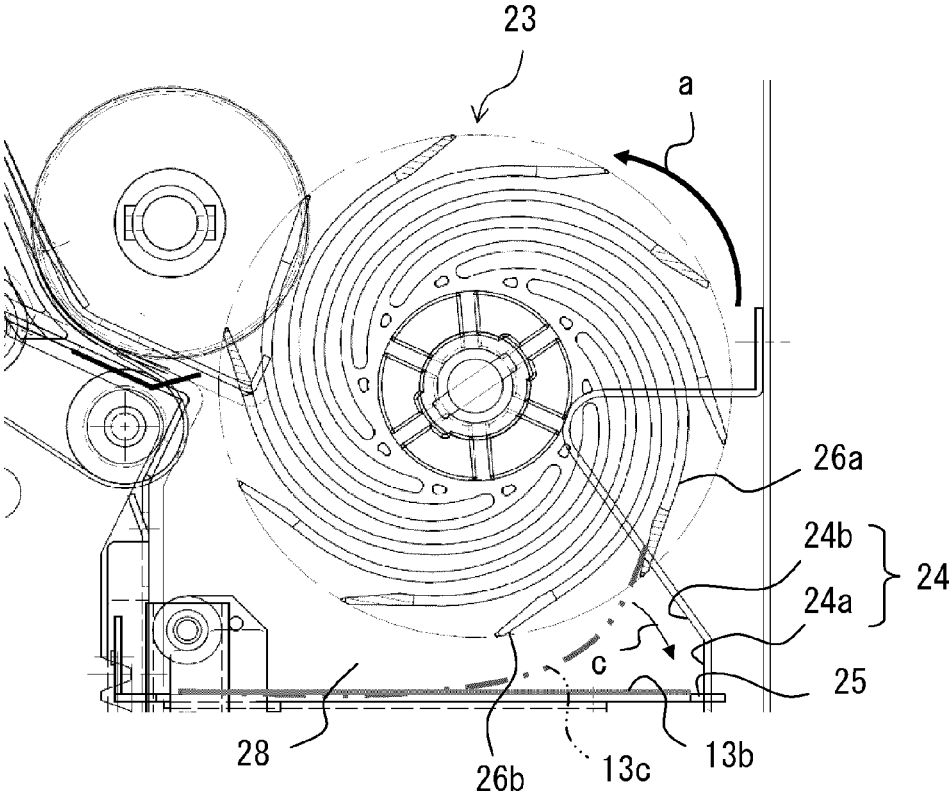
FIG. 5B is a side sectional view illustrating the accumulation operation, subsequent to FIGS. 3B and 4B, of the accumulation operation of the entered banknote in the swirling vane wheel accumulating apparatus according to the first embodiment.

FIG. 5A is a perspective view illustrating the accumulation operation of the entered banknote, subsequent to the above described rotational conveyance of the swirling vane wheel 23. FIG. 5B is a side sectional view of FIG. 5B. Only the components of FIGS. 5A and 5B, which are needed for the following description, are denoted with the same reference numerals as those of FIGS. 4A and 4B.

Both ends, which extend off the vanes 26, of each of the banknotes 13 (the preceding banknote 13*b* and the succeeding banknote 13*c*) that are held between the preceding vane 26*a* and the succeeding vane 26*b* and rotationally conveyed hit the overhanging tilting part 24*b* of the stoppers 24 to stop. Since the swirling vane wheel 23 continues to rotate, the banknote 13 is disengaged from the swirling vane wheel 23.

The front end of the banknote 13 that has been disengaged from the swirling vane wheel 23 drops along a slope of the overhanging tilting part 24*b* of the stoppers 24 as indicated with an arrow c, and accumulated, as the succeeding banknote 13*c*, onto the preceding banknote 13*b* that was disengaged from the swirling vane wheel 23 and accumulated in the accumulation part 28 earlier.

The upright part 24*a* of the stoppers 24 aligns the front ends of the banknotes 13 sequentially accumulated on the up-and-down stage 25. The up-and-down stage 25 is driven by the raising/lowering device 27 according to the number of sequentially accumulated banknotes 13, and gradually goes down to continuously form the accumulation part 28 formed with an appropriate space.

The first embodiment has been described by assuming that the swirling vane wheel accumulating apparatus configures the reject storing unit of an ATM. However, the swirling vane wheel accumulating apparatus of the present invention is not limited to this example. The swirling vane wheel accumulating apparatus of the present invention is applicable, for example, as a paper sheet storing apparatus used alone as an organizer of forms or a counter of valuable instruments.

What is claimed is:

1. A swirling vane wheel accumulating apparatus having an accumulation part for storing a paper sheet, comprising:

entering means for entering the paper sheet in the accumulation part via an entrance slot of the accumulation part;

stoppers arranged on an end side opposed to the entrance slot;

a swirling vane wheel arranged between the entrance slot and the stoppers;

a central upper guide member, arranged to extend from the entering means up to a position close to both sides of a rotational area of vanes of the swirling vane wheel, for guiding an upper surface of a central portion of the paper sheet entered in the accumulation part by the entering means while preventing the central portion from floating above;

both ends lower guide members, arranged on both sides of the entering means, for guiding both ends of the paper sheet entered in the accumulation part by the entering means, and for causing the paper sheet to curve in a shape of U by lifting up both the ends; and an up-and-down stage that is positioned below the swirling vane wheel and arranged to be able to go up and down independently of the entering means, the stoppers, the swirling vane wheel, the central upper guide member and the both ends lower guide members, wherein the swirling vane wheel holds, in a gap between vanes, the paper sheet entered by being curved in the shape of U via the entrance slot, rotates the paper sheet, causes both the ends of the paper sheet, which extend off both sides of the vanes, to hit the stoppers so that the paper sheet is disengaged from the gap between the vanes and accumulated on the up-and-down stage.

2. The swirling vane wheel accumulating apparatus according to claim 1, wherein the both ends lower guide members have a protruding part protruding from a surface of a conveyance direction of the paper sheet.

3. The swirling vane wheel accumulating apparatus according to claim 1 is configuring a reject storing unit for storing a paper sheet identified as being defective of deformed by an identifying unit on a side of an accepting apparatus that accepts the paper sheet.

* * * * *